US009802755B2

(12) United States Patent
Chakravarthy et al.

(10) Patent No.: US 9,802,755 B2
(45) Date of Patent: Oct. 31, 2017

(54) WASTE DISPOSAL DEVICE

(71) Applicant: Edgewell Personal Care Brands, LLC, St. Louis, MO (US)

(72) Inventors: Sumanth Chakravarthy, Stamford, CT (US); Alexander Chenvainu, Mahwah, NJ (US); Jennifer Chin, Stamford, CT (US); Dmitriy Faktorovich, Oakland, NJ (US); Stephen Mowers, Cheshire, DC (US); Vincent Valderrama, Staten Island, NY (US)

(73) Assignee: Edgewell Personal Care Brands, LLC, Chesterfield, MO (US)

( * ) Notice: Subject to any disclaimer, the term of this patent is extended or adjusted under 35 U.S.C. 154(b) by 52 days.

(21) Appl. No.: 14/936,031

(22) Filed: Nov. 9, 2015

(65) Prior Publication Data

US 2016/0229628 A1 Aug. 11, 2016

Related U.S. Application Data

(60) Provisional application No. 62/077,405, filed on Nov. 10, 2014.

(51) Int. Cl.

| | |
|---|---|
| ***B65F 1/08*** | (2006.01) |
| ***B65F 1/06*** | (2006.01) |
| ***B65F 1/16*** | (2006.01) |
| ***B65F 1/10*** | (2006.01) |

(52) U.S. Cl.

CPC ..... *B65F 1/062* (2013.01); *B65F 1/068* (2013.01); *B65F 1/10* (2013.01); *B65F 1/163* (2013.01); *B65F 1/1623* (2013.01); *B65F 2210/1026* (2013.01); *B65F 2210/126* (2013.01); *B65F 2210/129* (2013.01); *B65F 2240/132* (2013.01)

(58) Field of Classification Search

CPC .. B65F 1/1623; B65F 2210/129; B65F 1/163; B65F 2240/132

See application file for complete search history.

(56) References Cited

U.S. PATENT DOCUMENTS

| | | | | |
|---|---|---|---|---|
| 1,895,291 | A * | 1/1933 | Meyer | B65F 1/04 220/477 |
| 6,837,393 | B1 * | 1/2005 | Kuo | B65F 1/1607 220/263 |
| 8,910,821 | B1 * | 12/2014 | Stravitz | B65F 1/06 220/495.04 |
| 2004/0093837 | A1 * | 5/2004 | Mauffette | B65B 67/1277 53/576 |
| 2008/0221544 | A1 * | 9/2008 | Dommerholt | B65F 1/02 604/385.13 |
| 2013/0298506 | A1 * | 11/2013 | Lucas | B65F 1/062 53/452 |

* cited by examiner

*Primary Examiner* — Stephen Castellano
(74) *Attorney, Agent, or Firm* — Edgewell Personal Care Brands, LLC

(57) ABSTRACT

A pail facilitating ease of use having a pivotable removal bin. A retention structure pivots about a single axis, the retention structure having two sections that create an overlapping pinch about an upper surface in a first position and a lower surface in a second position. A cutter is located proximal the upper end of the removal bin.

4 Claims, 18 Drawing Sheets

WASTE DISPOSAL DEVICE

CROSS-REFERENCE TO RELATED APPLICATIONS

This application claims the benefit of priority to U.S. Provisional Patent Application Ser. No. 62/077,405 filed on Nov. 10, 2014, the contents of which are incorporated by reference herein.

BACKGROUND

Waste disposal devices are used to store soiled material. For example, a waste disposal pail may be used to store soiled diapers that have been removed from an infant. Once an associated load or capacity limit is reached, the soiled diapers need to be removed from the pail in order to accommodate future use.

Emptying a substantially full pail can prove challenging. For example, if a bag formed of a film is used to contain soiled diapers within the pail a user may cut the film to separate a first portion of the film containing the soiled diapers from a second portion of the film that is then allocated to future use. It can be awkward or difficult for the user to cut the film at an appropriate location without being exposed to noxious scents/odors. In some instances, some of the soiled diapers may even fall out of the first portion of the film bag once the cut has been made, which can lead to unsanitary conditions.

Additionally, conventional pails fail to maximize the load/capacity (e.g., number of soiled diapers) that can be accommodated by the pail, thereby resulting in the user having to empty the pail more frequently than she otherwise would have. Aside from this inconvenience, a user will frequently cut off slightly more film than is necessary to ensure that a bag of film filled with soiled diapers can be sealed (e.g., tied) at the end where the cut is made. Therefore, performing additional cuts of the film leads to inefficiencies (e.g., a greater depletion or use of film per diaper).

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
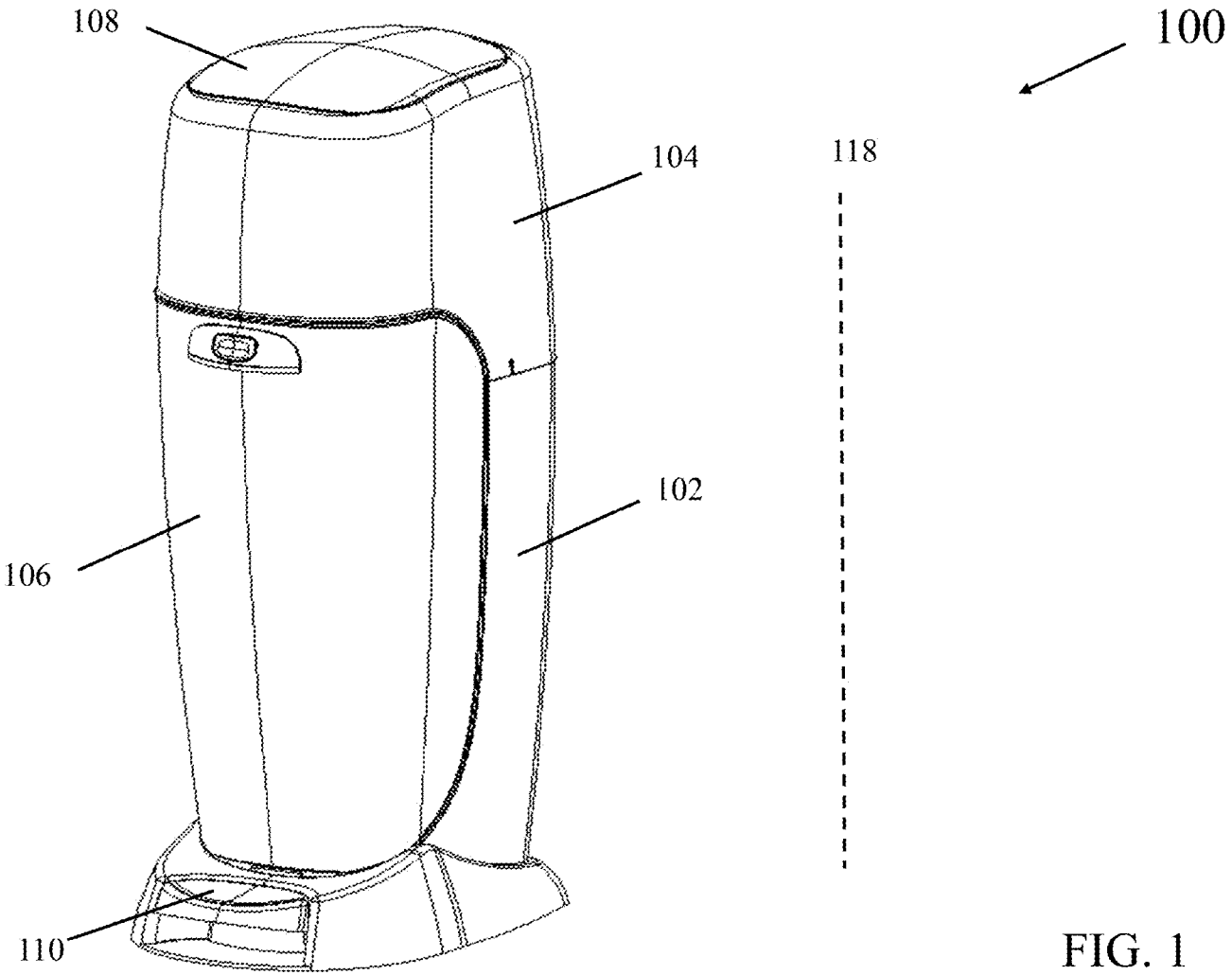
FIG. 1 illustrates a waste disposal device.

It is noted that various connections are set forth between elements in the following description and in the drawings (the contents of which are included in this disclosure by way of reference). It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities.

Referring to FIG. 1, a waste disposal device 100 in accordance with an embodiment is shown. The waste disposal device 100 may be used to store soiled material, such as soiled diapers.

The waste disposal device 100 includes a first housing 102, a second housing 104, and a bin 106.

The first housing 102 may be configured to balance a center of gravity of the waste disposal device 100 over a range of use of the waste disposal device. For example, the first housing 102 may be used to balance a center of gravity of the waste disposal device 100 over a range corresponding to: A) the waste disposal device 100 being empty of waste, and B) the waste disposal device 100, more specifically, the storage portion of the pail, being full of waste. In one embodiment, the storage portion is the bin 106.

Figure 8:
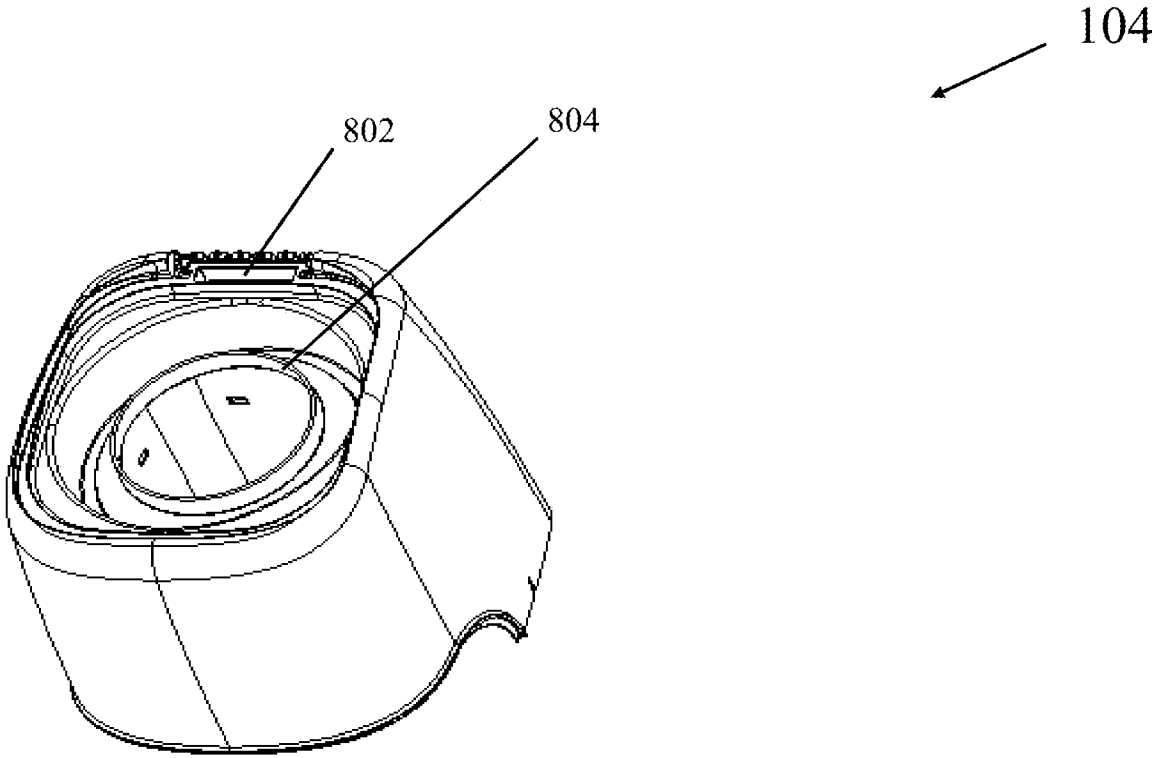
FIG. 8 illustrates a second housing of the waste disposal device of FIG. 1.

The second housing 104 may be configured to be coupled to the first housing 102 as shown in FIG. 1, such that the first housing 102 and the second housing 104 form a (portion of a) pail or tower. The second housing 104 may be configured to store a film (or other material) for containing waste within the waste disposal device 100. An example of such a film is the DIAPER GENIE REFILL PACK produced by PLAYTEX, which may be packaged as one or more cartridges/rolls of film. Briefly referring to FIG. 8, the second housing 104 may include a ring 804 that may serve as a keying with respect to the roll of film. The roll of film may include a counterpart key to ensure that the roll of film is inserted in the second housing in a given orientation/direction.

The bin 106 may be configured to be selectively coupled to the first housing 102. In FIG. 1, the bin 106 is shown as being coupled to the first housing 102 and is oriented at an angle that is (substantially) equal to zero degrees relative to a longitudinal axis (LA) 118 of the waste disposal device 100. In other words, in FIG. 1, the bin 106 is aligned with the LA 118.

The bin 106 may be configured to rotate about the LA 118 within a range of zero degrees and a threshold value. In some embodiments, this threshold value is between thirty degrees and forty degrees. For example, and referring to FIG. 2, the bin 106 is shown as having been rotated about the LA 118, such that the angle is no longer zero as in FIG. 1.

Figure 2:
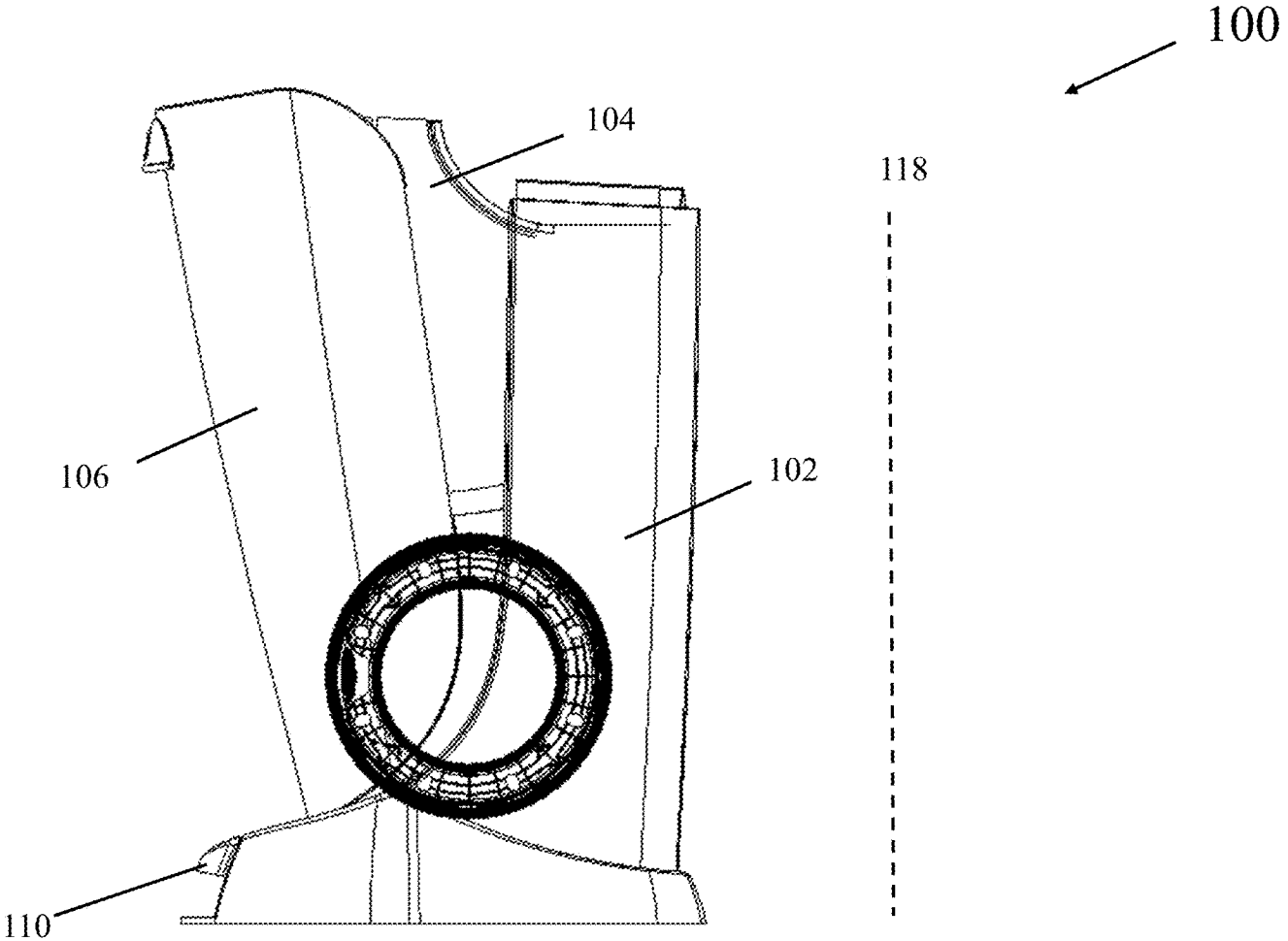
FIG. 2 illustrates the waste disposal device of FIG. 1 with a bin opened/rotated.

As shown in FIG. 2, the second housing 104 is decoupled from the first housing 102. The second housing 104, or a portion thereof, may be configured to fit within the first housing 102 (e.g., within a cavity formed by the first housing 102 and the bin 106) when the second housing 104 is decoupled from the first housing 102. Fitting the second housing 104 within the first housing 102 may be useful for decreasing/minimizing the profile or form factor of the waste disposal device 100 when the waste disposal device 100 is disassembled, such as when the waste disposal device 100 is packaged or shipped in commerce. The first housing 102 may be configured to be less than twenty-one inches in height in association with the LA 118. Such a constraint may adhere to one or more requirements (e.g., maximum shelf space/height at a retail location), while still allowing the waste disposal device 100 to increase/maximize the count or volume of soiled diapers that can be accommodated/stored therein.

Figure 3:
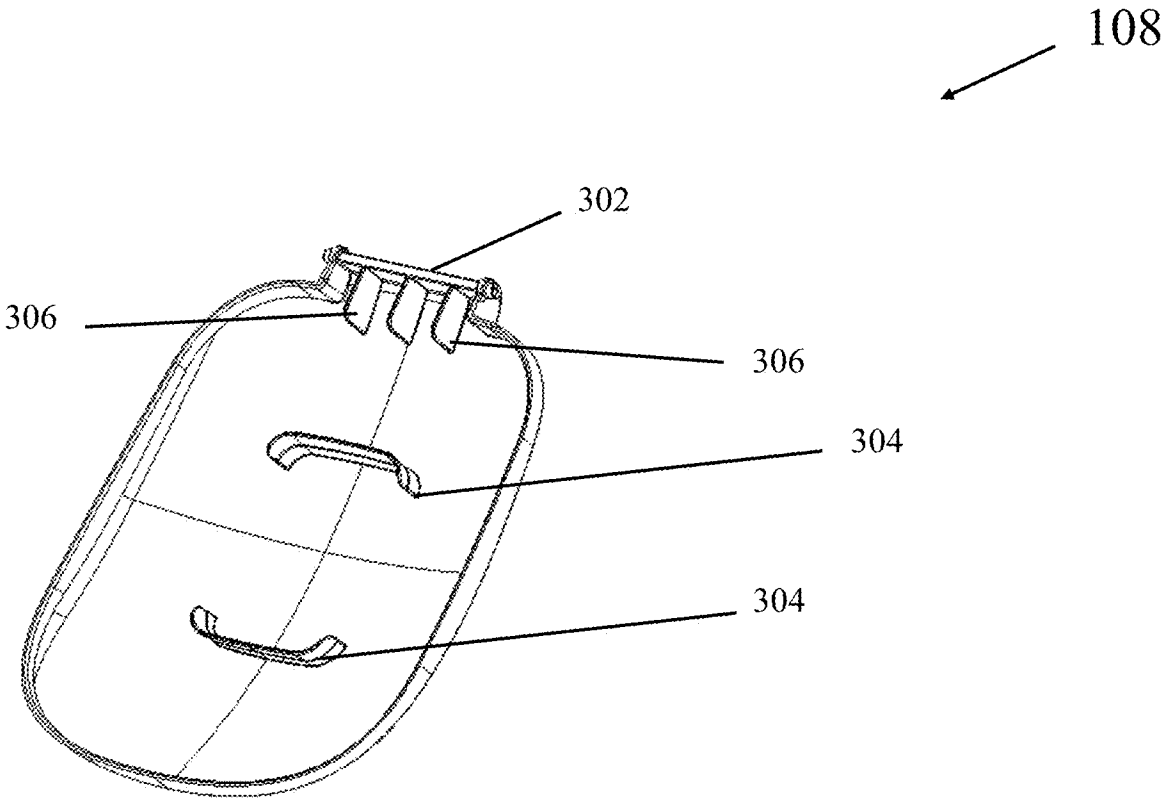
FIG. 3 illustrates a lid of the waste disposal device of FIG. 1.
Figure 4:
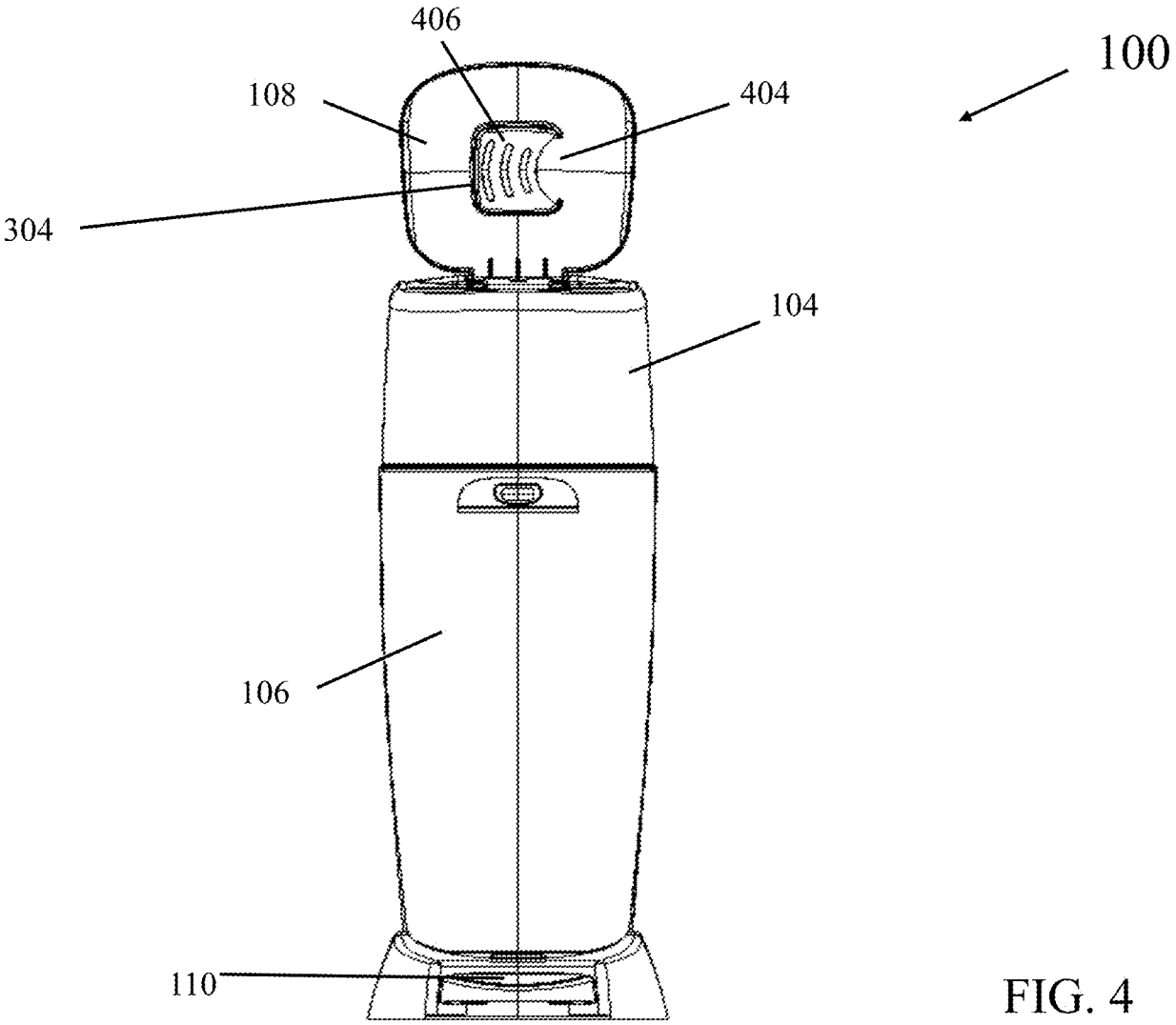
FIG. 4 illustrates the waste disposal device of FIG. 1 including a fragrance pack inserted into the lid of FIG. 3.

Referring to FIGS. 1, 3, and 4, the second housing 104 may be associated with a lid 108. The lid 108 may be configured to rotate about an axis 302 associated with the second housing 104, such that the lid 108 is configured to open and close. In FIG. 1, the lid 108 is shown in a closed position. In FIG. 4, the lid 108 is shown in an open position. When the lid 108 is in the closed position (e.g., FIG. 1), the lid 108 may be substantially flush with the (remainder of the) second housing 104. When the lid 108 is in the closed position, a user (e.g., a child) may be precluded access to the internal portion of the waste disposal device 100 via the second housing 104. The closure of the lid 108 may help to contain odors/scents emanating from soiled diapers within the waste disposal device 100. When the lid 108 is in the open position (e.g., FIG. 4), a user may gain access to the waste disposal device 100 via the second housing 104 in order to deposit waste (e.g., a soiled diaper) into the waste disposal device 100.

The lid 108 may include a receptacle 304 (e.g., a molded bracket) that is configured to receive a fragrance pack 406. The receptacle 304 may include an opening 404 to allow for a removal or insertion of the fragrance pack 406, thereby allowing a user to replace/replenish/recharge the fragrance pack 406.

The opening 404 may be substantially aligned with the axis of rotation 302 associated with the lid 108, such that the fragrance pack 406 is retained in the receptacle 304 as the lid 108 rotates from the closed position to the open position or from the open position to the closed position.

In some embodiments, the fragrance pack 406 may include an odor/scent absorbent. In some embodiments, the fragrance pack 406 may include a potpourri, a fragrance gel, baking soda, or any other material configured to emit a scent/odor, such as a scent/odor that may be pleasing to a user, or to absorb odors.

In terms of the opening and closing of the lid 108, an actuation mechanism may be used to control a state of the lid. For example, the actuation mechanism may be configured to open the lid 108 when the actuation mechanism is engaged. The actuation mechanism may be configured to close the lid 108 when the actuation mechanism is disengaged.

Referring to FIGS. 1, 2, and 4, in some embodiments the actuation mechanism may include a pedal 110. The pedal 110 may be configured to be depressed by a user's foot in order to open the lid 108. In the absence of a depression of the pedal 110, the lid 108 may close or remain closed. The pedal 110 may be associated with the first housing 102.

Figure 5:
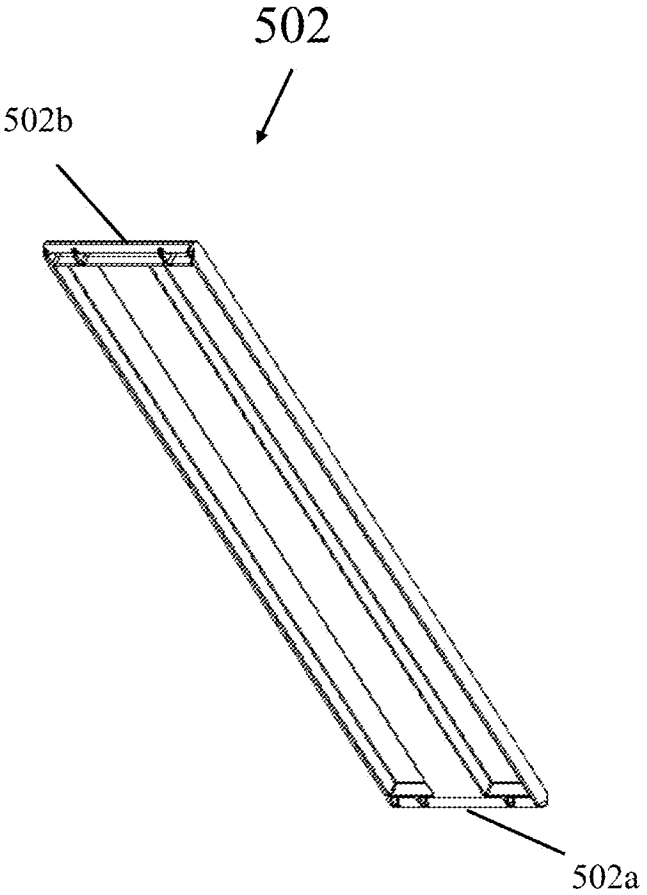

The actuation mechanism may include one or more pushrods. For example, referring to FIGS. 5-6, the pedal 110 may be coupled to a first end 502*a* of a first pushrod 502. A second end 502*b* of the first pushrod 502 may be coupled to a first end 602*a* of a second pushrod 602. Referring to FIGS. 1, 5, and 7, the first pushrod 502 may be at least partially retained within a channel 702 formed within the lower housing 102. Similarly, at least a portion of the pedal 110 may be retained within a channel 704 formed within the lower housing.

Referring to FIGS. 1, 3, 4, and 6, a second end 602*b* of the second pushrod 602 may selectively couple to the lid 108, such as when the pedal 110 is depressed, causing the lid 108 to open. For example, and referring to FIGS. 1, 3, 4, 6, and 7, when the pedal 110 is depressed, the first pushrod 502 may be translated within the channel 702. This translation of the first pushrod 502 may in turn cause a translation of the second pushrod 602, such that the second end 602*b* of the second pushrod 602 protrudes through an opening 802 formed in the second housing 104 (see FIG. 8) and contacts/engages one or more protrusions 306 formed in the lid 108 (see FIG. 3), thereby causing the lid 108 to rotate open about the axis 302.

In the absence of a depression of the pedal 110, the first pushrod 502 and the second pushrod 602 may be translated in such a way that the second end 602*b* of the second pushrod 602 disengages from the lid 108/protrusions 306 causing the lid 108 to close. The dimensions of one or more of the lid 108, the pedal 110, the protrusions 306, the first pushrod 502, and the second pushrod 602 may be selected so as to bias the lid 108 to close when the pedal 110 is not depressed.

Figure 6:
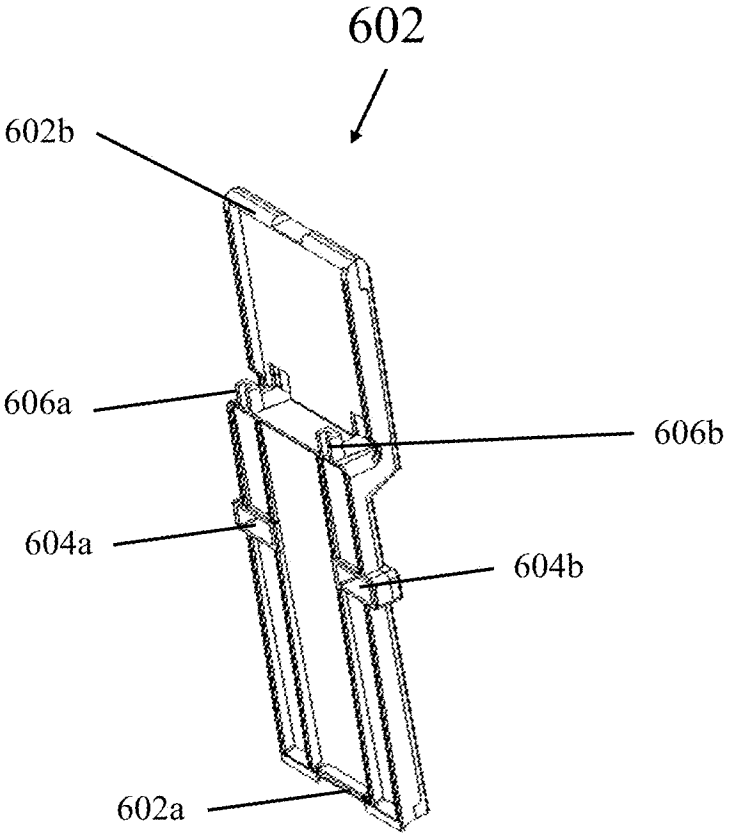
FIGS. 5-6 illustrate pushrods associated with the waste disposal device of FIG. 1.
Figure 7:
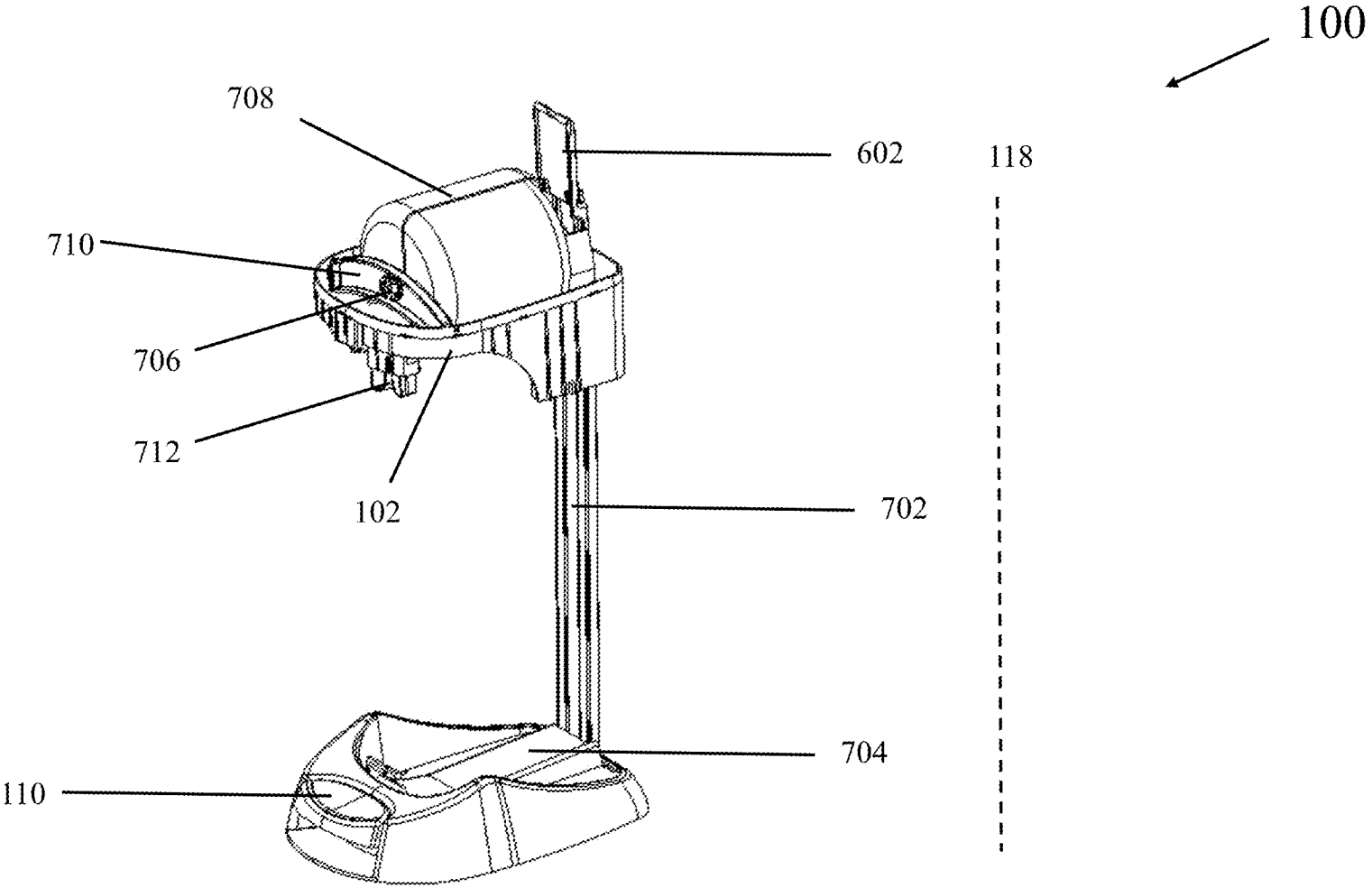
FIG. 7 illustrates a portion of the waste disposal device of FIG. 1 including a receptacle arranged about an axis.
Figure 10:
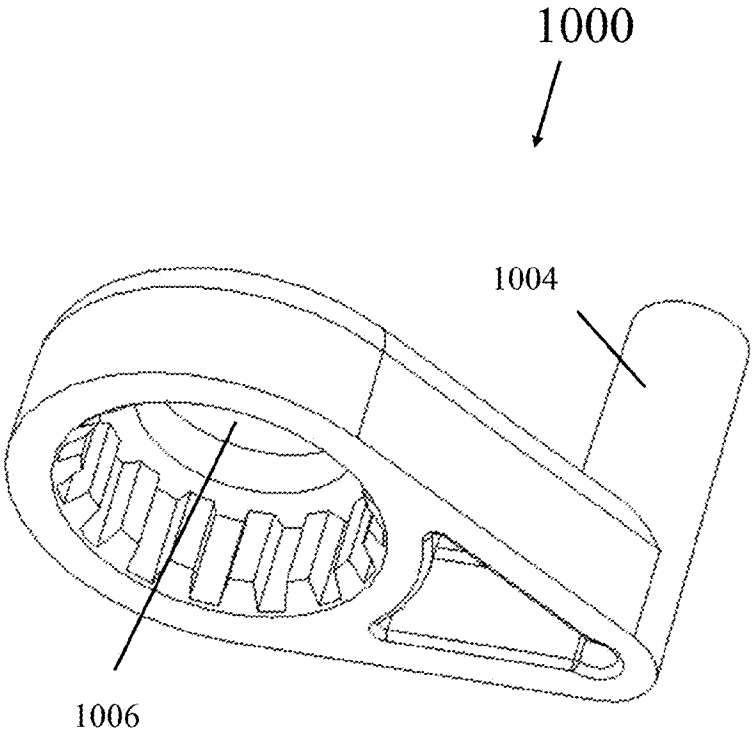
FIGS. 9-10 illustrate gears associated with the waste disposal device of FIG. 1.
Figure 9:
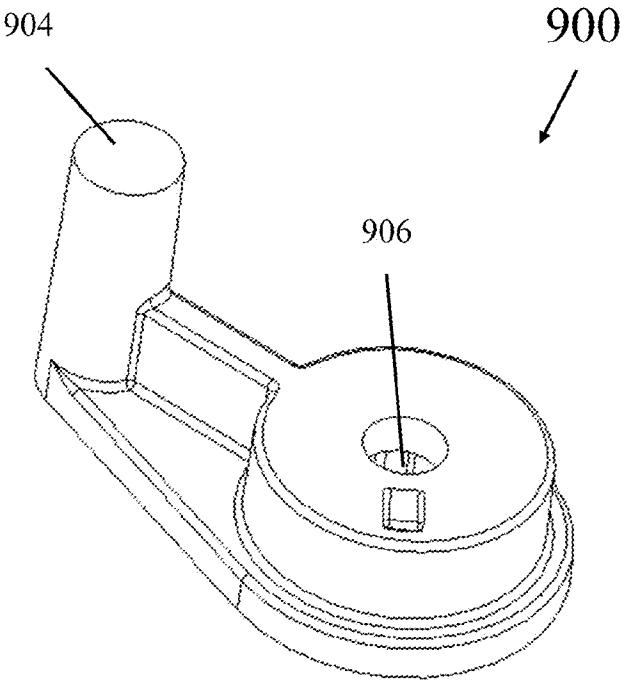

Referring to FIG. 6, the second pushrod 602 may be manufactured to include one or more slots or openings, such as slots 604*a* and 604*b*. Referring to FIGS. 6, and 9, the slot 604*a* may be configured to receive or couple to a flange 904 of a first gear 900. Referring to FIGS. 6 and 10, the slot 604*b* may be configured to receive or couple to a flange 1004 of a second gear 1000.

The first gear 900 and the second gear 1000 may be coupled to one another and centers 906 and 1006 of gears 900 and 1000, respectively, may help to define an axis 706 (see FIGS. 7 and 11A-11C) of rotation of a mechanism configured to receive waste when the actuation mechanism is engaged. For example, the gears 900 and 1000 may be mounted about the axis 706 with respect to a receptacle 708 (formed of sections 708*a* and 708*b* as described further below). As described further below, the receptacle 708 may be used to receive waste (e.g., soiled diapers). The gears 900 and 1000 may serve as a first terminal/termination point of the axis 706. Referring to FIGS. 7, 11A-11C, and 12, a bracket 710 may be configured to couple to: (A) the receptacle 708 and (B) (a portion of) the first housing 102. Referring to FIGS. 7 and 12, a center 1206 of the bracket 710 may be used to receive an end of the receptacle 708. The center 1206 may serve as a second terminal/termination point of the axis 706.

Figure 11C:
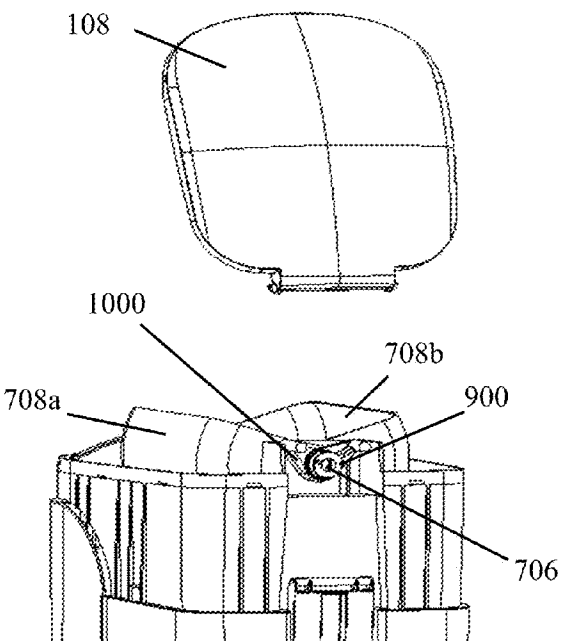
FIGS. 11A-11C illustrate a rotation of the gears of FIGS. 9-10 about an axis for opening/closing the lid of FIG. 3 and opening/closing the receptacle included in FIG. 7.
Figure 11B:
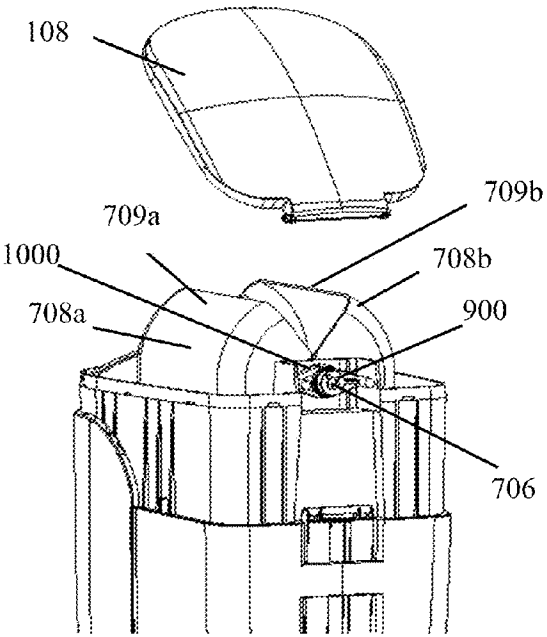
Figure 11A:
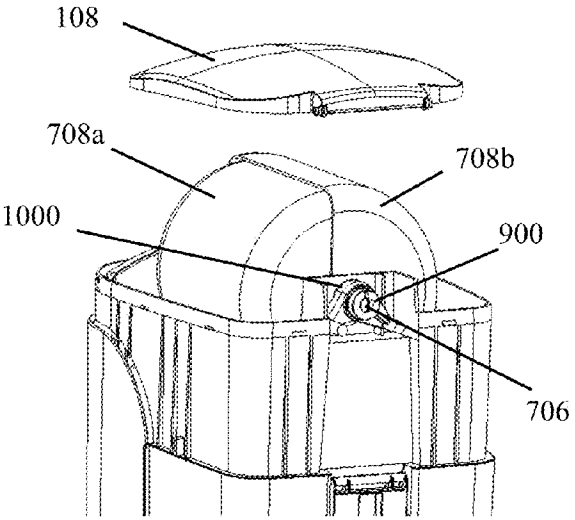
Figure 12:
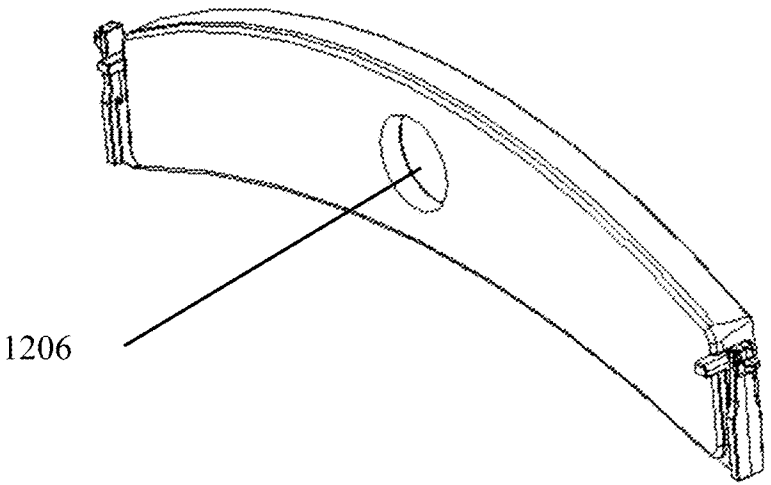
FIG. 12 illustrates a bracket for retaining the receptacle included in FIG. 7.

FIGS. 11A-11C illustrates various states associated with a depression of the pedal 110. For example, FIG. 11A may coincide with an absence of a depression of the pedal 110. FIG. 11B may coincide with a partial depression of the pedal 110 and/or partial release of the pedal 110. FIG. 11C may coincide with a full depression of the pedal 110.

In the absence of a depression of the pedal 110 (FIG. 11A), the receptacle 708 is in a closed state such that the receptacle 708 does not receive waste. Receptacle 708 has sections 708*a* and 708*b* having upper portions 709*a* and 709*b*, respectively, that are in an overlapped state such that any film within pail 100 is pinched about at least one point, and in preferred embodiments, at least at two points. The overlapped sections 708*a* and 708*b* assist in creating a tortuous path in the film such that it is more difficult for odorous air to travel through the film and out of section 708 and into the head space of pail when lid 108 is at least partially closed. In FIG. 11A, the lid 108 is shown in a generally horizontal position coinciding with the lid 108 being closed.

When the pedal 110 is partially depressed (FIG. 11B), the receptacle 708 is in a partially open state. In FIG. 11B, the partial opening associated with the receptacle 708 may accommodate small amounts/volumes of waste (e.g., a wipe, tissue paper, etc.) but might not accommodate a full load of waste (e.g., a soiled diaper). Relative to FIG. 11A, in FIG. 11B the lid 108 is shown in a partially opened state.

When the pedal 110 is fully depressed (FIG. 11C), the receptacle 708 is in a (fully) open state. In this open state, the receptacle may accommodate a deposit of a full load of waste (e.g., a soiled diaper). In this state, the receptacle 708 has sections 708*a* and 708*b* with lower portions 707*a* and 707*b*, respectively, that are in an overlapped state such that any film within pail 100 is pinched about at least one point, and in preferred embodiments, at least at two points. The overlapped sections 707*a* and 707*b* assist in creating a tortuous path in the film such that it is more difficult for odorous air to travel through the film and out of section 708 and outward from the pail as the lid 108 is at least partially open. Relative to FIG. 11B, in FIG. 11C the lid 108 is shown as being (fully) opened.

After the receptacle 708 has received waste and/or when the pedal 110 is released, (a) the lid 108 begins to close and (b) the receptacle 708 goes from a (i) closed position where the waste is above the receptacle 708 and the receptacle 708 forms at least one pinch closure between the waste and the storage portion of the waste disposal device 100, such as the bin 106, to (ii) an open position wherein the waste passes the receptacle 708 and into the storage portion of the waste disposal device 100, and then back to (iii) a close position where the waste is within the storage portion of the waste storage device 100 and the receptacle 708 forms at least one pinch closure.

In some embodiments, receptacle 708 has a spring (not shown) that assist in transitioning receptacle 708 from an open position to a closed position. The spring is optionally positioned on the inner portion of sections 708*a* and 708*b* and/or the outer portion of section 708*a* and 708*b*. In some embodiments, spring is attached to gears 900 and 1000 at flange portions 904 and 1004. Preferably, spring is positioned in the center portion of sections 708*a* and 708*b* (i.e. other than upper portions 709*a* and 709*b*, and other than lower portions 707*a* and 707*b*). As receptacle 708 opens and/or closes, the spring acts quickly forces receptacle 708 into such opened or closed position. This is advantageous as it reduces the amount of the time receptacle 708 is in an intermediate state and thereby permitting odor to escape storage portion of pail 100 into the headspace (i.e. when the lid is at least partially closed) and/or out of the pail (i.e. when the lid is at least partially opened).

Figure 13:
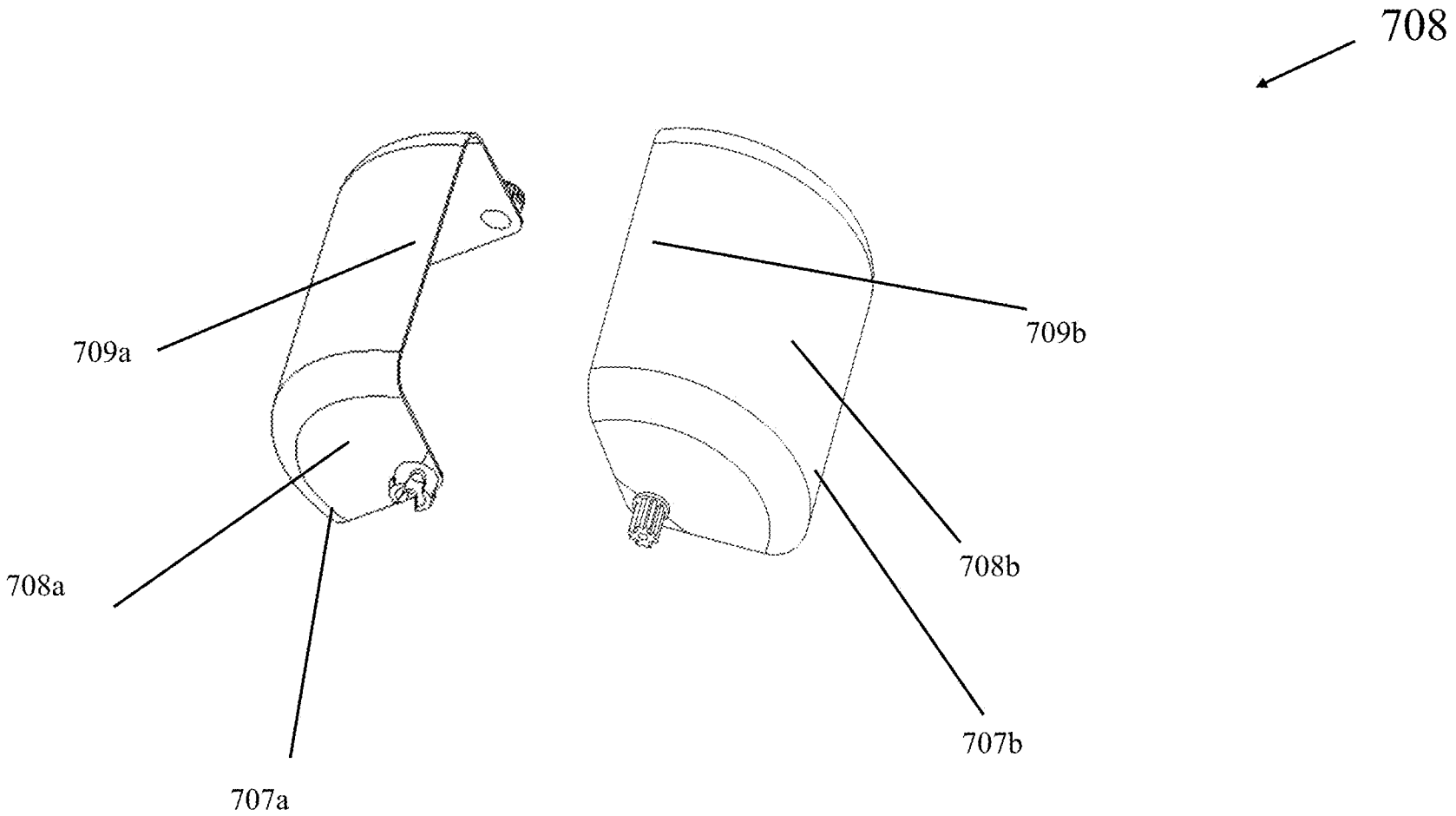
FIG. 13 illustrates sections of the receptacle included in FIG. 7.

As shown in FIG. 13, and with reference to FIGS. 7 and 11A-11C, the receptacle may be formed from one or more sections/pieces, such as sections 708*a* and 708*b*. The sections 708*a* and 708*b* may be configured to rotate about the axis 706. The dimensions of the sections 708*a* and 708*b* may be selected/configured such that when the actuation mechanism is disengaged (e.g., in the absence of a depression of the pedal 110) a first of the sections (e.g., the section 708) is at least partially nested within a second of the sections (e.g., the section 708*b*). Nesting a first of the sections 708*a*, 708*b* within a second of the sections 708*a*, 708*b* may help to retain (unpleasant) scents/odors within the waste disposal device 100 (see, e.g., FIG. 1) by causing any such scents/odors to have to traverse a tortuous path to potentially escape the waste disposal device 100.

Figure 14:
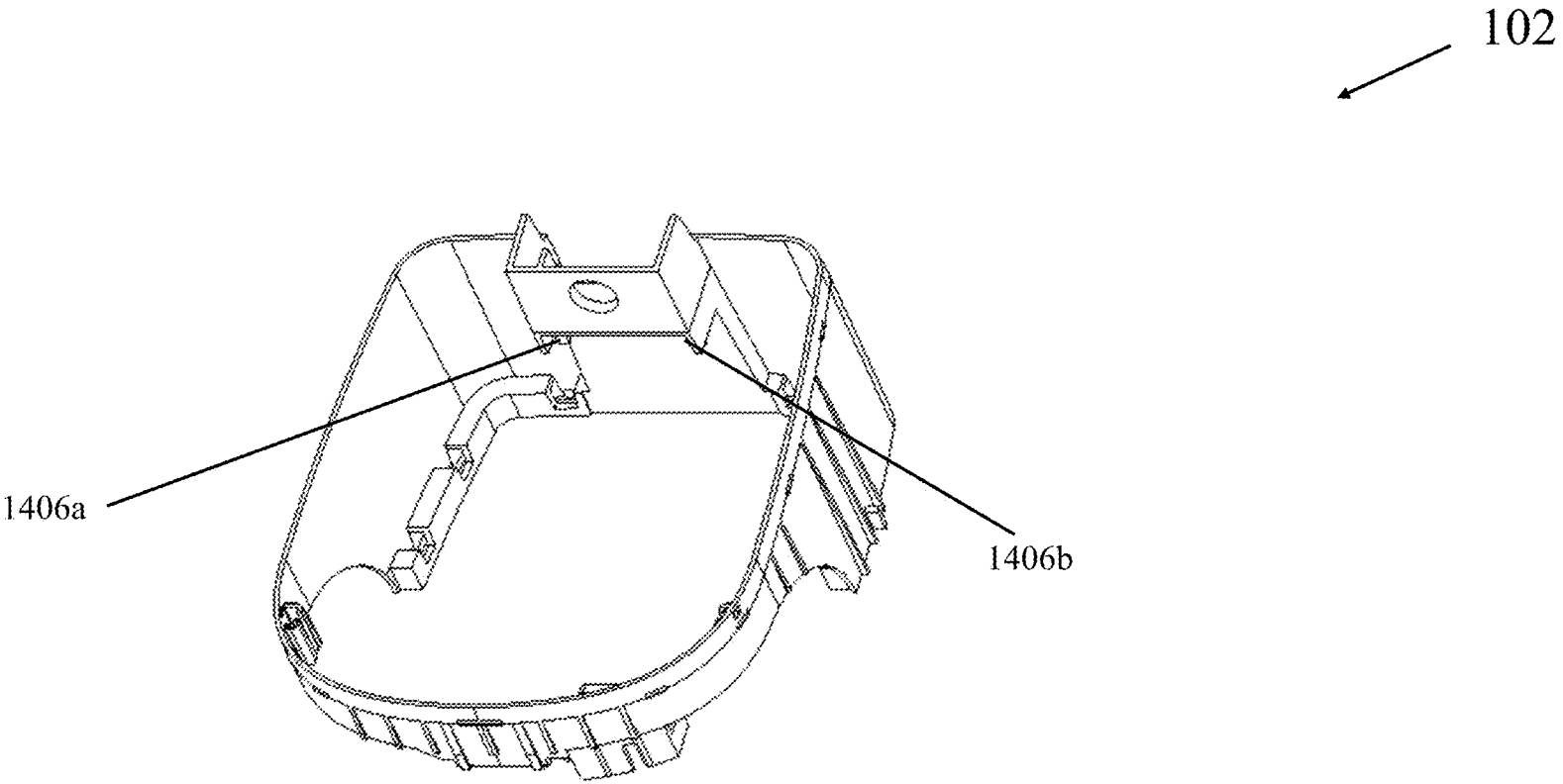
FIG. 14 illustrates a portion of a first housing of the waste disposal device of FIG. 1.

Referring to FIGS. 1 and 6, in some embodiments, the waste disposal device 100 may include at least one biasing member (not shown) coupled to, e.g., the second pushrod 602 and the first housing 102. In some embodiments, the at least one biasing member may include one or more springs. As shown in FIG. 6, the second pushrod 602 may include one or more hooks or protrusions, such as protrusions 606*a* and 606*b*. As shown in FIG. 14, (a portion of) the first housing 102 may include a first protrusion 1406*a*. While not specifically shown in FIG. 14, the first housing 102 may include a second protrusion in proximity to the area identified by reference character 1406*b*. The protrusions 606*a*, 606*b*, 1406*a*, and 1406*b* may be used to receive a hoop or hook associated with a biasing member/spring. For example, the protrusion 606*a* may receive a first hoop or hook associated with a first spring and the protrusion 1406*a* may receive a second hoop or hook associated with the first spring. Similarly, the protrusion 606*b* may receive a first hoop or hook associated with a second spring and the protrusion 1406*b* may receive a second hoop or hook associated with the second spring. In this respect, the first spring and the second spring may be located on substantially opposite sides of the second pushrod 602.

The biasing member(s)/spring(s) may serve to stretch/expand when the actuation mechanism is engaged (e.g., the pedal 110 is depressed) to cause/enable the second pushrod 602 to cause the lid 108 to partially or fully open and to cause the receptacle 708 to partially or fully open (e.g., FIGS. 11B and 11C). Conversely, when the actuation mechanism is disengaged (e.g., an absence of a depression of the pedal 110), the biasing member(s)/spring(s) may bias the second pushrod 602 to cause the lid 108 to close or remain closed and cause the receptacle to close or remain closed (e.g., FIG. 11A). The biasing member(s)/spring(s) may also serve to retain the second pushrod 602 in-line with the first pushrod 502 substantially about the LA 118—see, e.g., FIGS. 1, 2, and 5-7.

Figure 20:
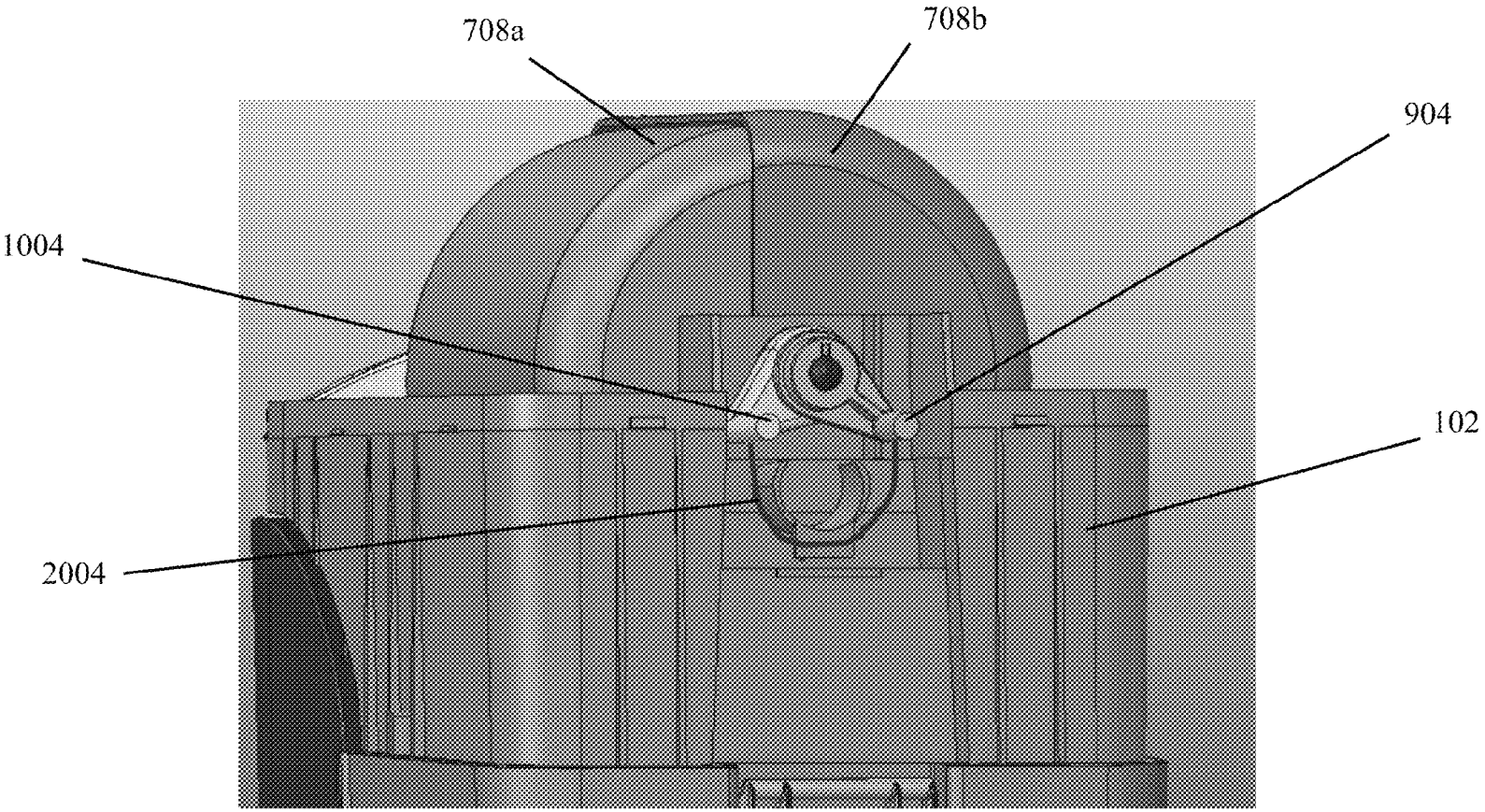
FIG. 20 illustrates elements of the waste disposal device of FIG. 1.

Referring to FIG. 20, and in view of FIGS. 1, 9, and 10, an embodiment is shown where the flanges 904 and 1004 are coupled to one another via a biasing member 2004. The biasing member 2004 may be a spring. In the embodiment of FIG. 20, the pushrods 502 and 602 (see, e.g., FIGS. 5-6), guides the opening of the receptacle sections 708*a* and 708*b*, such that the lengths of the pushrods 502 and 602 determine the degree or extent to which the sections 708*a* and 708*b* rotate. The biasing member 2004 controls the closing of the sections 708*a* and 708*b* and keeping the sections 708*a* and 708*b* closed at rest (e.g., in the absence of actuation of the actuation mechanism/pedal 110).

Figure 15B:
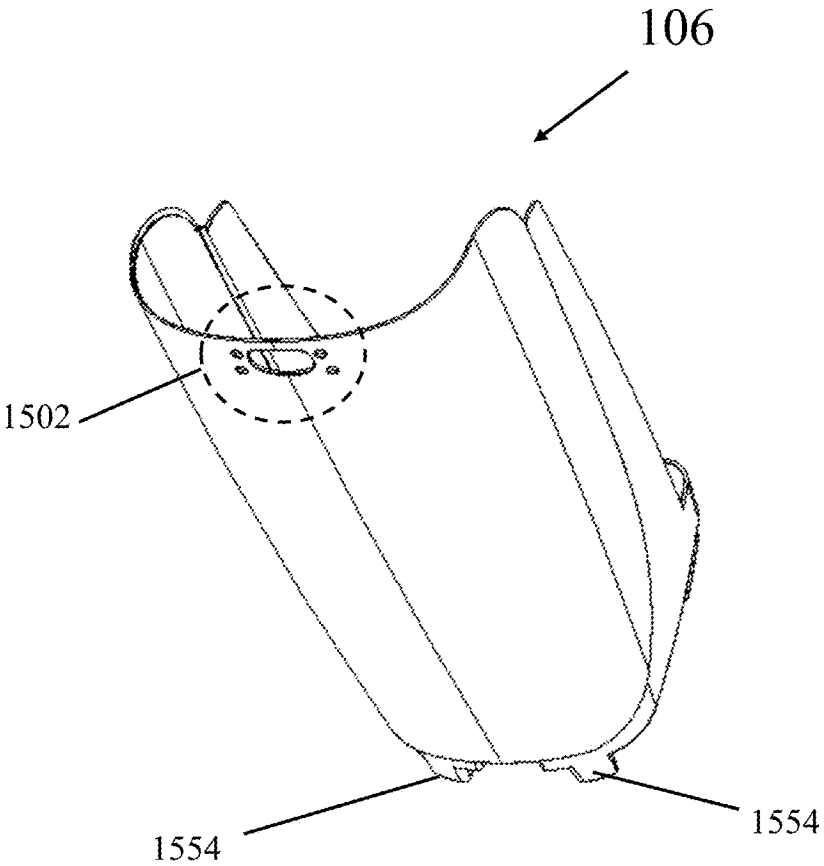
FIGS. 15A-15B illustrate a bin of the waste disposal device of FIG. 1.
Figure 15A:
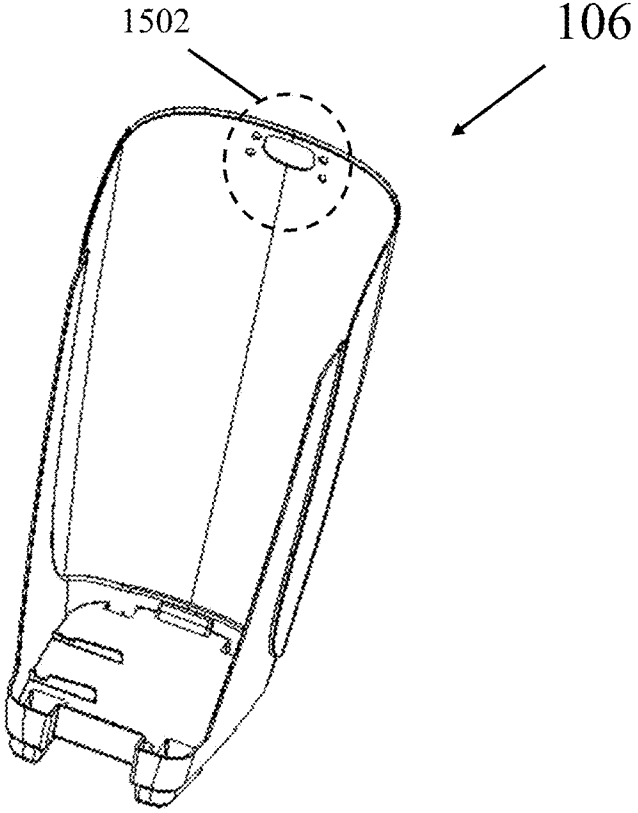

As described above, and in reference to FIGS. 1-2, the bin 106 may be configured to rotate about the LA 118 to facilitate servicing (e.g., emptying) the waste disposal device 100. As shown in FIGS. 15A-15B, the bin 106 may include one or more holes or orifices in the area/region identified by reference character 1502. The holes/orifices 1502 may accommodate/seat a bracket/handle 1600 (see FIG. 16) therein.

Figure 17:
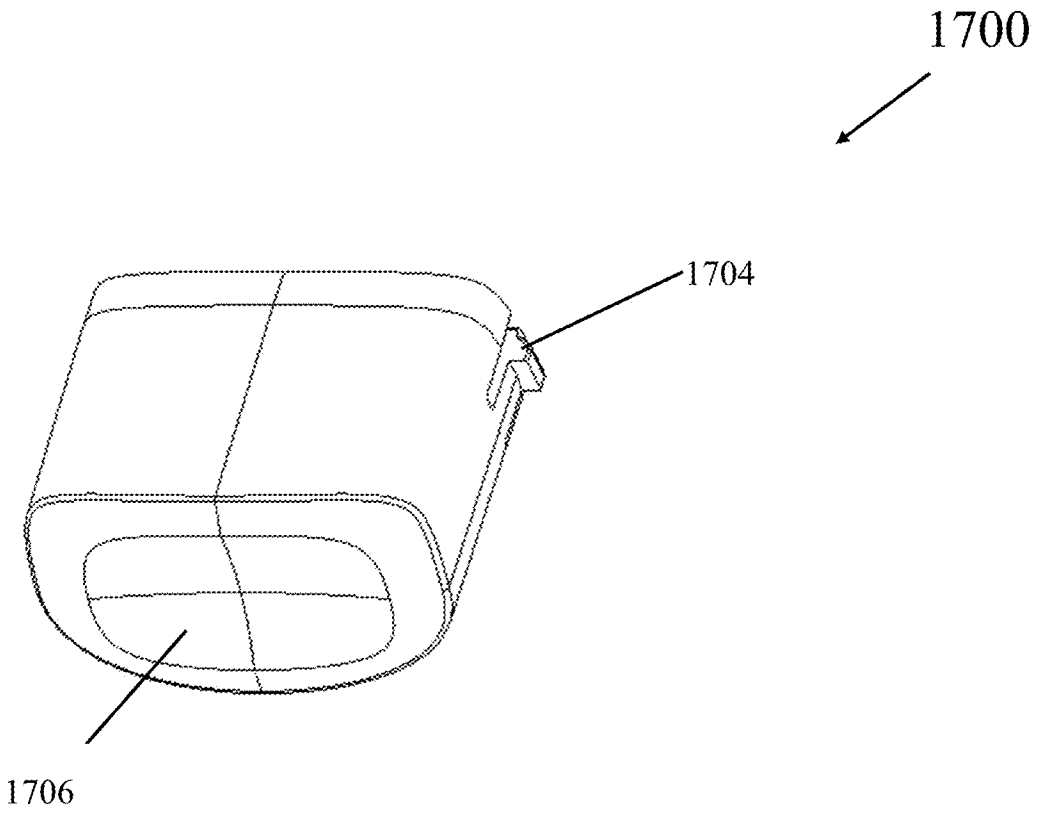
FIG. 17 illustrates a button associated with the bracket/handle 1600 of FIG. 16.

The bracket/handle 1600, or a center 1602 thereof, may in turn accommodate/seat a button 1700 (see FIG. 17).

Figure 16:
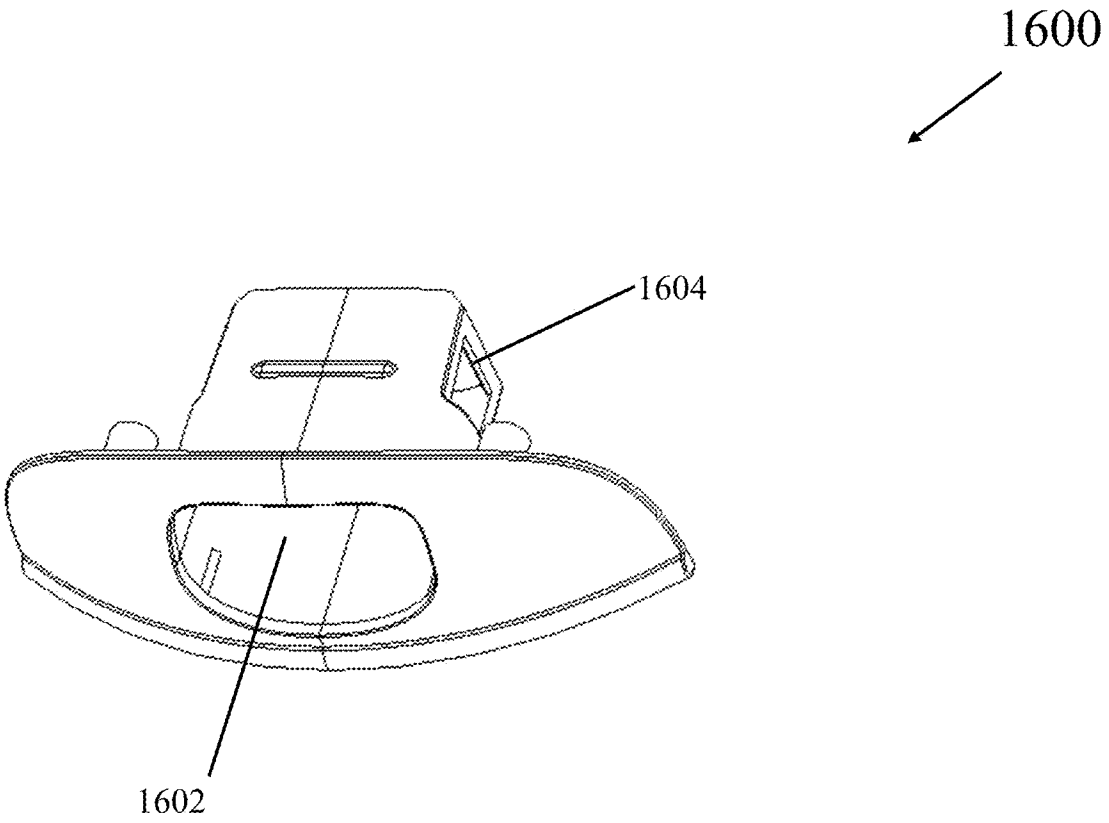
FIG. 16 illustrates a bracket/handle 1600 associated with the bin of FIGS. 15A-15B.
Figure 18:
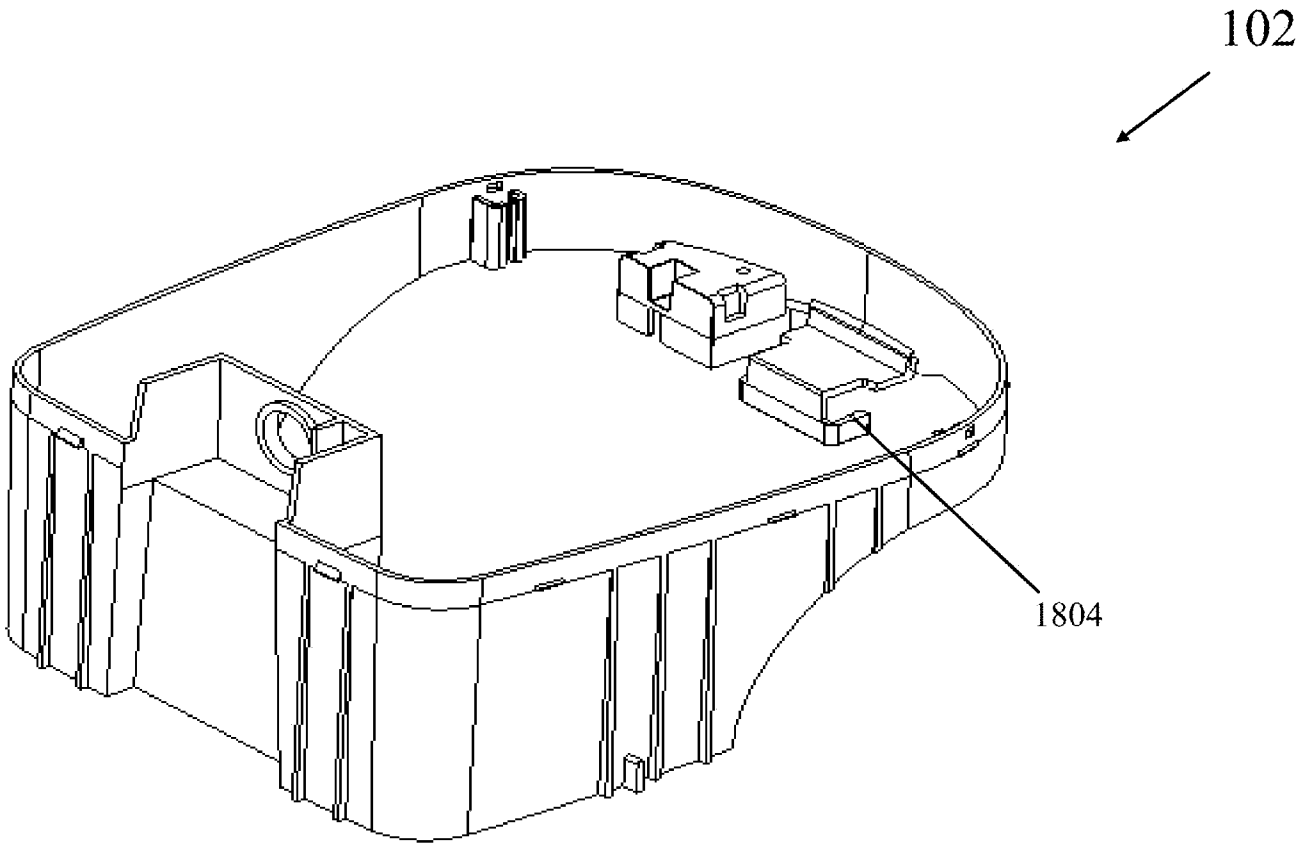
FIG. 18 illustrates a portion of a first housing of the waste disposal device of FIG. 1.

Referring to FIGS. 16 and 18, the bracket/handle 1600 may include one or more sidewalls 1604 that may selectively engage one or more hooks/arms 1804 associated with (a portion of) the first housing 102. For example, when the bin 106 is closed flush against the first housing 102 (as in FIG. 1), the sidewall 1604 may be captured or retained by the hook/arm 1804. A depression of (a center 1706 of) the button 1700 may cause a flange/arm 1704 of the button 1700 to contact the hook/arm 1804, which in turn may cause a separation/disengagement of the hook/arm 1804 from the sidewall 1604 allowing the bin 106 to rotate about the LA 118 towards the position of the bin 106 as seen in FIG. 2. A user may pull on the bracket/handle 1600 in conjunction with depressing the (center 1706 of the) button 1700 to cause the bin 106 to rotate/open. To close the bin 106, the user may apply a minimal force to the bin 106 or bracket/handle 1600 until the sidewall 1604 reengages the hook/arm 1804.

Referring to FIGS. 1, 2, and 15B, the bin 106 may include one or more hooks/flanges 1554 that may selectively engage or abut a portion of the first housing 102. The hooks/flanges 1554 may limit a range of rotation of the bin 106 about the LA 118 to a threshold amount, such that the bin 106 may come to rest in terms of its rotation once this threshold is reached. Limiting the range of rotation may be useful to prevent the bin 106 from falling on a user (e.g., the user's leg or foot) as the user is opening the bin 106. Thereafter, the user may pull up on the bin 106 to (completely) decouple the bin 106 from the first housing 102. A user may (completely) decouple the bin 106 from the first housing 102 in order to use the bin 106 as a sort of carrying-tray for transporting or discarding of waste.

Figure 19:
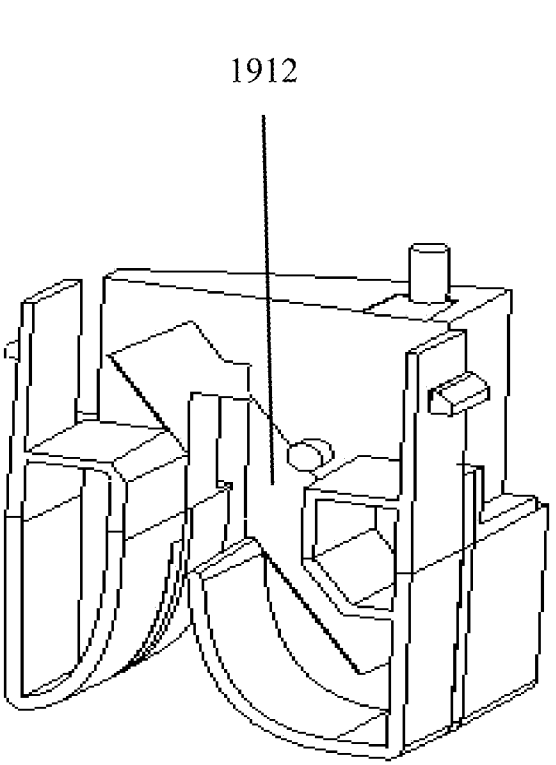
FIG. 19 illustrates a cutter of the waste disposal device of FIG. 1.

As described above, a film (or other material) may be used to store waste within the waste disposal device 100. Referring to FIGS. 7 and 19, a cutter 712 may be associated with the first housing 102. The cutter 712 may include one or more blades/razors 1912 that may be used to cut the film in order to generate (A) a first portion of the film (or a bag of the film) that contains waste to be removed from the waste disposal device 100 and (B) a second portion of the film that may be allocated for future waste collection in connection with the use of the waste disposal device 100. As shown via FIGS. 1, 2, 7, and 19, the cutter 712 may be located in proximity to a top side/end of the bin 106, such that it may be relatively easy for a user to insert film to be cut into the cutter 712 even when the bin 106 is substantially full of waste.

While some of the examples described herein related to waste (e.g., soiled diaper) storage and disposal, one skilled in the art would appreciate that aspects of the disclosure may be used to store materials other than waste.

Technical effects and benefits of this disclosure include an ability to service/empty a waste disposal device by causing a bin associated with the waste disposal device to rotate about a longitudinal axis of the waste disposal device. In this manner, and unlike some other waste disposal devices, the waste disposal device may remain flush against a wall (or other object) when such servicing/emptying takes place. The waste disposal device may include a receptacle configured to receive waste for deposit/submission into the waste disposal device, where the receptacle is arranged as one or more sections that are configured to rotate about a common axis. Such an arrangement for the receptacle may reduce a number of mechanical components/devices that are used, thereby simplifying the fabrication/manufacture of the waste disposal device. An overlapping or nesting of the sections of the receptacle may be used to reduce/minimize an escape/leakage of odors/scents from the waste disposal device.

Aspects of the disclosure have been described in terms of illustrative embodiments thereof. Numerous other embodiments, modifications, and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional in accordance with aspects of the disclosure. One or more features described in connection with a first embodiment may be combined with one or more features of one or more additional embodiments.

What is claimed is:

1. A waste disposal device comprising:

an upper housing;

a bracket coupled to the upper housing;

a bin selectively coupled to the upper housing, the bin configured to store waste; and a receptacle configured to receive waste for submission into the bin, wherein the receptacle comprises two sections that are configured to rotate about a common axis, and wherein the bracket is configured to retain a front end of the receptacle and serve as a front termination point of the common axis.

2. The waste disposal device of claim 1, further comprising:

an actuation mechanism, wherein a first of the two sections is at least partially nested within a second of the two sections when the actuation mechanism is disengaged.

3. The waste disposal device of claim 1, further comprising:

a plurality of gears coupled to the upper housing and configured to retain a back end of the receptacle and serve as a back termination point of the common axis.

4. The waste disposal device of claim 3, further comprising:

a biasing member configured to couple a first flange associated with a first of the gears to a second flange associated with a second of the gears.

* * * * *